United States Patent [19]

Bucher

[11] Patent Number: 5,067,481

[45] Date of Patent: Nov. 26, 1991

[54] CONTROL DEVICE FOR AN AIR-BUBBLE MASSAGE APPLIANCE

[75] Inventor: Heinz Bucher, Rottweil, Fed. Rep. of Germany

[73] Assignee: Metronic Electronic, GmbH, Fed. Rep. of Germany

[21] Appl. No.: 571,664

[22] PCT Filed: Feb. 23, 1989

[86] PCT No.: PCT/DE89/00105

§ 371 Date: Sep. 4, 1990

§ 102(e) Date: Sep. 4, 1990

[87] PCT Pub. No.: WO89/07927

PCT Pub. Date: Sep. 8, 1989

[30] Foreign Application Priority Data

Mar. 3, 1988 [DE] Fed. Rep. of Germany ..... 3806858

[51] Int. Cl.[5] ..... A61H 9/00

[52] U.S. Cl. ..... 128/66; 128/65; 4/538; 4/541; 4/542; 4/543; 4/544

[58] Field of Search ..... 128/65, 66; 261/19, 261/20, 30; 4/541-544, 538, 492

[56] References Cited

U.S. PATENT DOCUMENTS

| | | | |
|---|---|---|---|
| 2,793,640 | 5/1957 | Schwartz . | |
| 3,286,712 | 11/1966 | Roden . | |
| 3,481,328 | 12/1969 | Powell . | |
| 3,695,781 | 10/1972 | LaBarber . | |
| 4,004,302 | 1/1977 | Hori | 4/543 |
| 4,325,149 | 4/1982 | Moreland | 4/542 |
| 4,518,325 | 5/1985 | Kingston . | |
| 4,726,917 | 2/1988 | Abe | 4/542 |

FOREIGN PATENT DOCUMENTS

| | | |
|---|---|---|
| 1803255 | 8/1959 | Fed. Rep. of Germany . |
| 7738955 | 12/1977 | Fed. Rep. of Germany . |
| 3135717 | 3/1983 | Fed. Rep. of Germany . |
| 3430879 | 8/1984 | Fed. Rep. of Germany . |
| 3738364 | 12/1988 | Fed. Rep. of Germany . |
| 408272 | 10/1909 | France . |

*Primary Examiner*—Robert A. Hafer
*Assistant Examiner*—Brian E. Hanlon
*Attorney, Agent, or Firm*—Speckman & Pauley

[57] ABSTRACT

A control device for an air-bubble massage appliance has an external housing containing an electric motor driven blower enclosed by a cover and also containing an internal housing having a horizontally aligned connecting piece which connects on one end to an opening in the external housing for an air hose and on the opposite end to air outlet slits in the blower cover. The external and internal housings have overlapping water discharge outlets in their respective floors to isolate any water which may enter the device from electrical components of the device. The housing floors also have at least one air aspirating opening. The electric motor is housed in the upper portion of an aspirating hood above a blower hood, thereby forming an aspirating chamber, and drives at least one fan wheel on a vertical shaft extending from the underside of the motor. The blower cover is sealed against the blower hood by profile packings. The open underside of the blower hood has an aspirating opening which is connected by an aspirating conduit to an inner chamber of the aspirating hood.

26 Claims, 2 Drawing Sheets

CONTROL DEVICE FOR AN AIR-BUBBLE MASSAGE APPLIANCE

BACKGROUND OF THE INVENTION

1. Field of the Invention

This invention relates to a control device for an air-bubble massage appliance with a housing in which a blower drivable by means of an electric motor and enclosed by a cover is positioned, in which an external housing consisting of a lower housing part and an upper housing part contains an internal housing with a connecting piece for an air hose, which extends toward the external housing and is connected to a hose connecting opening of the external housing, where the external housing and the internal housing are provided with water discharge openings so that water returning into the internal housing through the connecting piece is isolated from the electric motor when the blower is shut off and can flow out of the internal and external housings, and where the external housing, which is comprised of the lower housing part and the upper housing part, which are connected with each other in an air tight manner, is divided along a horizontal separation plane.

2. Description of Prior Art

A control device of this type is disclosed by German DE-C 37 38 364. In this known control device, the electric motor and the blower are placed horizontally in the housing but positioned outside of the internal housing. The air aspirated by the blower is conducted into the inner chamber of the internal housing through a compressed air connector, which is in contact with the blower, to a fixed place above the hose connecting piece. In this case, part of the internal housing covers the blower. As a result, the electric motor is not adequately cooled and it is not possible to clean and heat the aspirated air in a simple and effective manner.

It is the object of this invention to provide a control device of the previously mentioned type, in which the structure of the external and internal housings results in an improved flow of the aspirated air and also provides an opportunity for the installation of additional devices, if desired, (for example a heating element for heating and a filter for cleaning the aspirated air) without hindering the drainage of the water which may be returning.

This object is attained in accordance with this invention by an internal housing consisting of an aspirating hood and a blower hood divided in a horizontal separating plane and connected airtight at the separating plane, with an electric motor housed in the aspirating hood positioned above the blower hood and on its underside inside the blower hood driving a fan wheel or a plurality of fan wheels on a vertical shaft surrounded by a cover, where the aspirating hood holds the electric motor in the upper area of the aspirating hood by means of a profile packing, creating an aspirating chamber which is in contact with the external housing, where the cover is provided with circumferentially positioned air outlet slits and is sealed on both sides thereof by means of profile packings against the blower hood, where the open underside of the blower hood, positioned at a distance from the floor of the lower housing part and functioning as an aspirating opening, is connected to an aspirating conduit which issues from the inner chamber of the aspirating hood, where the water discharge opening is positioned in the floor of the lower housing part which is provided with at least one air aspirating opening, the connecting piece of the blower hood is aligned horizontally and is connected with the air exhaust slits of the cover of the fan wheel, where the lower housing part of the exterior housing is provided with at least one air aspirating opening, and where the water discharge openings of the exterior housing and the interior housing are positioned so as to overlap each other in the lower area of the aspirating conduit of the aspirating hood.

By means of the upright arrangement of the external and internal housings, two separate chambers are formed, where the aspirated air is aspirated at the floor of the external housing and enters the internal housing at the top of the internal housing and only reaches the chamber of the fan wheel through the aspirating conduit of the open underside of the blower hood after passing the aspirating hood and cooling the electric motor contained therein. In this manner the aspirated air can be heated in the area of the aspirating hood and can be easily cleaned before entering the blower hood and prior to being conducted by the blower to the connecting piece of the blower hood and subsequently to the air hose inserted in the hose connecting opening. The water discharge opening always is in the lowest part of the external housing and the distance to the electric motor and thus to the electrically conducting parts in the area of the aspirating hood and the upper housing part is comparatively large, so that even the entire lower housing part can be filled with returning water without coming into contact with electrically conducting parts. The air exhaust through the connecting piece of the blower hood is assured by the connecting piece being aligned horizontally and connected with the air exhaust slits of the cover of the fan wheel.

In a preferred embodiment of this invention the connecting piece is positioned symmetrically in respect to the separating plane of the external housing and connects to the hose connecting opening located symmetrically in respect to the separating plane. In this case it is easy to install the hose connecting opening in the divided external housing.

The entry of the air into the aspirating hood for cooling the electric motor with simultaneous mounting is attained where the upper part of the electric motor is covered by a guide hood, which is maintained in an upper opening of the aspirating hood by means of the profile packing, where the guide hood is supported through the profile packing on a sleeve-like piece with inlet slits on the cover wall of the upper housing part, and where the aspirating chamber is formed between the guide hood and the cover wall of the upper housing part.

Because the aspirating opening of the blower is at a distance from the floor of the lower housing part, cleaning of the aspirated and heated air can be simply achieved by covering the aspirating opening of the aspirating hood by means of a filter, while for heating the air the electric motor is surrounded on its end facing the cover for the fan wheel by an electric heating element positioned in the inner chamber of the internal housing.

In an embodiment of the invention, the fastening of the filter is done in such a way that the filter is covered by a filter hood which is connected through slits in the wall with the aspirating conduit extending from the inner chamber of the aspirating hood and further that the filter hood rests on the floor of the lower housing part and is provided with a water discharge opening which, together with the water discharge opening in the floor a lower housing part, forms a water discharge from the external housing and the internal housing. At the same time the aspirated air can be admitted without hindrance from the aspirating conduit through the slits of the filter hood to the filter and above it to the aspirating opening of the blower.

The aspirated air provided to the inner chamber of the aspirating hood can be accelerated in its circulating speed by closing the cover of the fan wheel on the side facing the electric motor, so that the inner chamber of the fan wheel chamber is not in communication with the inner chamber of the aspirating hood. The aspirated air flowing through the aspirating hood exits on the underside of the aspirating hood, flows around the heating element and then reaches the aspirating conduit. In an embodiment of this invention, the aspirating conduit through which the aspirated air flows from the inner chamber of the aspirating hood to the aspirating opening of the blower hood is formed by a wall of the filter hood and by a portion of the outer wall of the blower hood and covered by means of an overhanging area formed on the aspirating hood and where the sleeve-like aspirating hood is recessed in the area of the overhang.

If according to an embodiment of this invention positioning pieces are fixed on the inner wall of the connecting piece, the insertion movement of the connecting piece provided on the end of the air hose is limited.

In another embodiment of the invention, the tight seal between the lower housing part and the upper housing part of the external housing is achieved by the lower housing part and the upper housing part overlapping in the area of the separating plane by means of oppositely offset connecting pieces which are of reduced thickness, while the connection between the aspirating hood and the blower hood of the inner housing is achieved where the blower hood ends, on its side facing the aspirating hood, in a coaxial double connecting piece into which the facing front end of the aspirating hood is inserted.

In yet another embodiment, the fixing of the inner housing in its lower area is achieved where the blower hood is supported on the floor of the lower housing part through the lower profile packing and the filter hood.

Mechanical connection between the lower housing part and the upper housing part of the external housing is attained by the lower housing part and the upper housing part having formed on them raised bolt covers aligned with each other, through which they are both bolted together. The raised bolt covers of the lower housing part extend beyond the underside of the floor of the lower housing part to form receiver sleeves for flexible footpads so that it is possible to place the control device on delicate surfaces without danger of scratches or the like.

A further embodiment provides that the air aspirating openings of the lower housing part are in the shape of sleeves formed on it, which are open in the area of the floor of the lower housing part and which extend into the inner chamber of the external housing. In this way the air aspirating openings are always unencumbered and the aspirated air is already collected and guided in the direction towards the upper part of the housing in the area of these aspirating openings.

DESCRIPTION OF PREFERRED EMBODIMENTS

Figure 1:
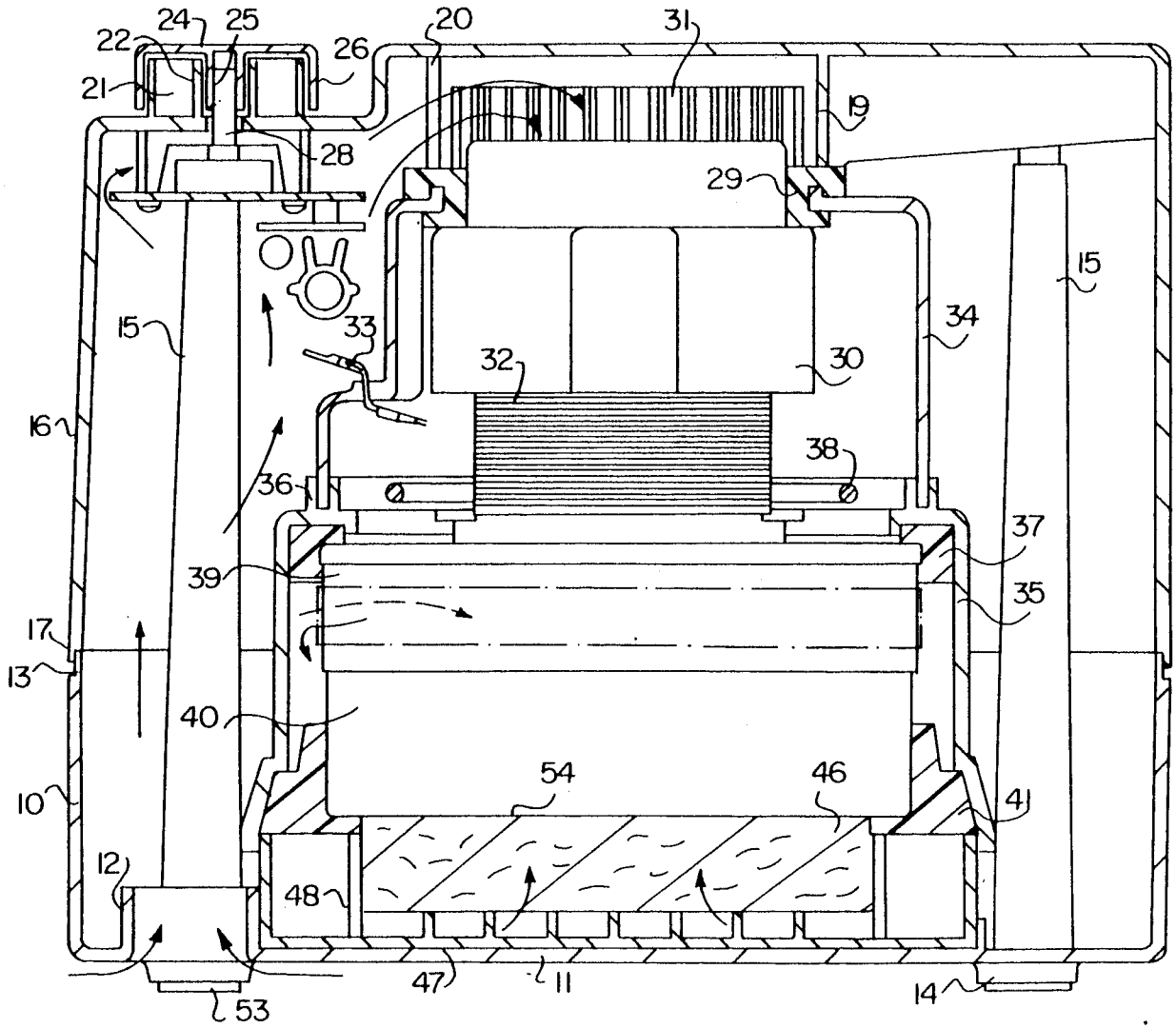
FIG. 1 is a longitudinal section through the external housing and internal housing of the control device, which makes clear the routing of the aspirated air from the air aspirating openings in the floor of the lower housing part into the aspirating hood of the inner housing and from there through the aspirating conduit to the aspirating opening of the blower hood.
Figure 2:
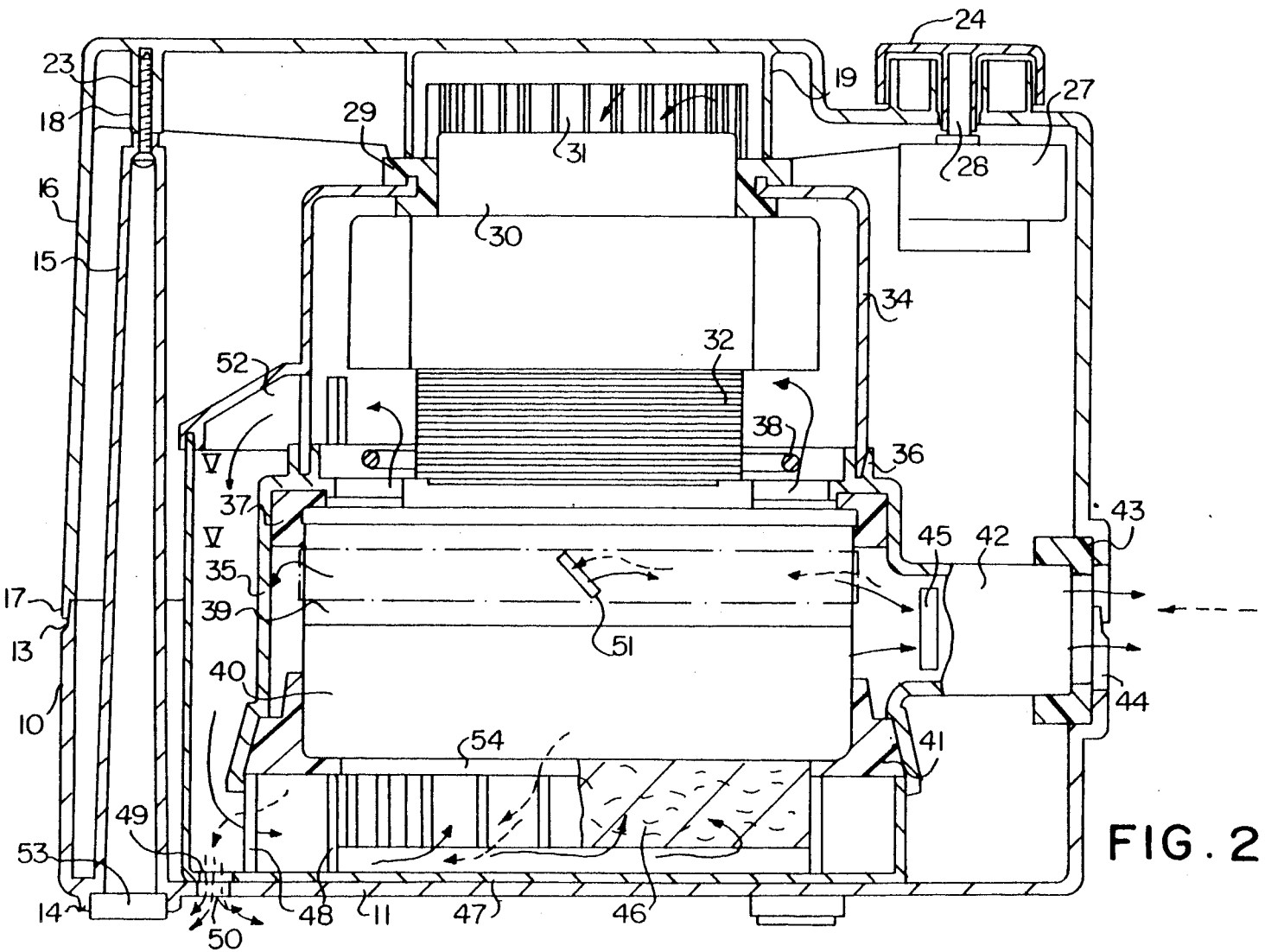
FIG. 2 is an offset longitudinal section showing the further routing of the aspirated air in the form of compressed air to the connecting piece and the hose connecting opening.

In the exemplary embodiment shown in FIGS. 1 and 2, the control device has an external housing, comprising the lower housing part 10, the upper housing 16 and the floor 11, and the internal housing, comprising the aspirating hood 34 and the blower hood 35. The external housing and the internal housing each are connected airtight in horizontal separating planes 17 and 36, respectively. In the separating area 17, connecting pieces offset in respect to each other are positioned on the lower housing part 10 and the upper housing part 16, which are braced against each other when the two parts are bolted together. Bolting occurs in the raised bolt covers 15 formed on the inside of the floor 11 and the raised bolt covers 18 formed on the inside of the cover wall of the upper housing part 16, as shown by the bolts 23. The raised bolt covers 15 extend downward on the underside of the floor 11 of the lower housing part 10 in the form of receiving sleeves 14, which are closed by means of flexible footpads 53 in order to allow the placement of the control device even on delicate surfaces without fear of scratching them. Furthermore, air aspirating openings 12 are made in the floor 11 of the lower housing part 10 in the shape of sleeves starting on the floor 11 of the lower housing part 10 and extending into the inner chamber of the external housing.

The aspirating hood 34 is located on top of the blower hood 35. The two parts are inserted into each other in the separating plane 36, the blower hood 35 ends in a coaxial double connecting piece which receives the front side of the aspirating hood facing it in a locking manner to obtain a tight connection. The aspirating hood 34 encloses the electric motor 32 with a vertically oriented motor shaft extending into the inner chamber of the blower hood 35 and being fixed there against rotation with a fan wheel, which is covered by means of the divided cover 39, 40. Support and fixation of the internal housing with the electric motor 32 and the blower are achieved by means of the profile packing 29 and the guide hood 30. The guide hood 30 is maintained by means of the profile packing 29 in the open top surface of the aspirating hood 34, the profile packing 29 being supported on the sleeve-like piece 19 formed on the inside of the cover of the upper housing part 16. In this way the aspirating chamber 31 is formed between the guide hood 30 supported in this way and the cover of the upper housing part 16, which may be formed, for example, as an open part of the guide hood 30 and be connected with the inner chamber of the external housing through the slits 20 in the piece 19.

The open underside of the blower hood 35 is supported on the floor 11 of the lower housing part 10 by means of the profile packing 41 and the filter hood 47.

The filter hood 47 contains the filter 46, which covers the underside of the blower hood 35, which is formed as aspirating opening 54. In the area of the edge the filter hood 47 is provided with slits 48, so that there is a connection between the aspirating opening 54 and the aspirating conduit 52. The aspirating conduit 52 is divided by the filter hood 47 and a portion of the outer wall of the blower hood 35 and verges into the inner chamber of the aspirating hood 34 in the area of the separating plane 36 of the internal housing. At the same time a part formed out of the wall of the aspirating hood 34 covers the top of the aspirating conduit 52. The filter hood 47 is supported by its floor on the floor 11 of the lower housing part 10. In the area of the aspirating conduit 52 the floor of filter hood 47 and the floor 11 of the lower housing part 10 have water discharge openings 49 and 50, which are aligned with each other.

Facing the electric motor 32, the blower with the cover 39, 40 is sealed by means of the profile packing 37 against the blower hood 35, the same as is provided by the profile packing 41 in the lower area. The cover 29 has circumferentially disposed slits 51 between the two profile packings 37 and 41. In this area the horizontally aligned connecting piece 42 is attached to the blower hood 35 and verges symmetrically to the separating plane 17 into the hose connecting opening 44 in the external housing and is sealed against it by means of the seal ring 43. Positioning pieces 45 are disposed in the connecting piece 42, which limit the insertion movement of the connecting piece of the air hose.

The cover 39, 40 is closed in the area of the separating plane 36 between the blower and the electric motor 32, so that the inner chamber of the aspirating hood 34 is connected via the recessed opening in the wall of the aspirating hood 34 only with the aspirating conduit 52, but not with the inner chamber of the blower. The heating element 38, which surrounds the electric motor 32, is positioned in this transition area and can be supplied with current through the supply lines 33 brought in through the aspirating hood 34. In this way the aspirated air exiting on the underside of the aspirating hood 34 reaches the aspirating hood 34. In this way the aspirated air exiting on the underside of the aspirating hood 34 reaches the aspirating conduit 52 after having been heated by flowing around the heating element 38. The electric motor 32 can also be turned on and off by means of these supply lines 33, for which an adjustable timing switch 27 is preferably used. The timing switch 27 is adjusted by means of the shaft 28, which extends through the cover of the upper housing part 16 and is connected with a turning knob 24. Sleeve-like necks 21 and 22 are formed on the upper housing part 16 which, together with the peripheral edge 26 and the receptacle 25 for the shaft 28, result in a splash-proof protection.

When the electric motor 32 is switched on, the blower creates a stream of aspirated air which begins at the always unencumbered air aspirating openings 12 in the floor 11 of the lower housing part 10 and directedly enters the inner chamber of the external housing. The aspirated air stream reaches the guide hood 30 in the inner chamber of the aspiration hood 34 through the slits 20 in the piece 19 of the upper housing part 16 and the aspirating chamber 31, so that the electric motor 32 is adequately cooled. The aspirated air stream is conducted from the aspirating hood 34 into the aspirating conduit 52. The aspirated air stream is also heated in this area. The aspirated air stream leaving the aspirating conduit 52 reaches the aspirating opening 54 of the blower hood 35 through the slits 48 in the filter hood 47, cleaned by the filter 46.

The fan wheel or fan wheels positioned in the cover 39, 40 of the single or multi-stage blower direct the aspirated air stream as a compressed air stream to the connecting piece 42, through which the compressed air stream can be transmitted to a bubble mat placed in a bath tub. The course of the aspirated air stream and of the compressed air stream is shown in the drawings by solid arrows.

When the electric motor 32, and with it the blower, is switched off, the compressed air stream is eliminated at the connecting piece 42 and the hose connecting opening 44. In this operational state it might be possible for water to flow back into the control device through the bubble mat and the air hose. The water enters through the connecting piece 42 and reaches the inner chamber of the blower hood 35. In the inner chamber of the blower hood 35 the water can enter into the blower through the slits 51 and leave again through the Aspiration opening 54. After passing the filter 46 and the filter hood 47, the water will run out of the control device through the water discharge openings 49 and 50. In FIG. 2 the course of the water is indicated by dashed arrows. The returning water can rise to almost the separating plane 36 of the internal housing without coming into contact with electrically conducting parts of the control device. The flow-off speed is determined by the diameter of the water discharge openings 49 and 50. It should not be made too large because a portion of the aspirated air stream can also leave the aspirating conduit 52 through the water discharge openings 49 and 50, as can be seen from the solid arrows in FIG. 2.

I claim:

1. A control device for an air-bubble massage appliance which comprises an external housing containing a blower which is drivable by means of an electric motor (32) and enclosed by a cover (39, 40), said external housing having a lower housing part (10) and an upper housing part (16) and containing an internal housing having a connecting piece (42) for an air hose, said connecting piece (42) extending toward said external housing and connecting to a hose connecting opening (44) of said external housing, said external housing and said internal housing having water discharge openings (49, 50), so that water returning into said internal housing through said connecting piece (42) is isolated from said electric motor (32) when said blower is shut off and can flow out of said internal and external housings, said lower housing part (10) and said upper housing part (16) connecting with each other in an airtight manner along a horizontal separation plane (17), said internal housing having an aspirating hood (34) and a blower hood (35) connecting with each other in an airtight manner in a horizontal separating plane (36), said electric motor (32) housed in said aspirating hood (34) above said blower hood (35) on its underside within said blower hood (35) driving at least a fan wheel on a vertical shaft surrounded by said cover (39, 40), said electric motor (32) being held in an upper area of said aspirating hood (34) by means of a profile packing (29), creating an aspirating chamber (31) which is in contact with said external housing, said cover (39, 40) having circumferentially positioned air outlet slits (51) and being sealed on both ends by means of profile packings (37, 41) against said blower hood (35), said blower hood (35) having an open underside, at a distance from a floor (11) of said lower housing part (10), and further having an aspirating opening (54) which is connected to an aspirating conduit (52) which issues from an inner chamber of said aspirating hood (34), said water discharge opening (50) being located in said floor (11) of said lower housing part (10), said floor (11) having at least one air aspirating opening (12), said connecting piece (42) of said blower hood (35) being aligned horizontally and connected with said air exhaust slits (51) of said cover (39, 40) of said fan wheel, said lower housing part (10) of said external housing having at least one air aspirating opening (12), and said water discharge openings (49, 50) of said external housing and said internal housing overlapping each other in a lower area of said aspirating conduit (52) of said aspirating hood (34).

2. A control device according to claim 1, wherein said connecting piece (42) is disposed symmetrically about said separating plane (17) of said external housing and connects to said hose connecting opening (44) also disposed symmetrically about said separating plane (17).

3. A control device according to claim 2, wherein an upper part of said electrical motor (32) is covered by a guide hood (30), said guide hood (30) being held in an upper opening of said aspirating hood (34) by means of said profile packing (29), said guide hood (30) is supported through said profile packing (29) on a sleeve-like piece (19) with inlet slits (20) on a cover wall of said upper housing part (16), and said aspirating chamber (31) is formed between said guide hood (30) and said cover wall of said upper housing part (16).

4. A control device according to claim 3, wherein said aspirating opening (54) of said blower hood (35) is covered by means of a filter (46).

5. A control device according to claim 4, wherein said filter (46) extends into a filter hood (47) which is connected by means of slits (48) in a wall, with said aspirating conduit (52) extending from an inner chamber of said aspirating hood (34), and said filter hood (47) sits on said floor (11) of said lower housing part (10) and has a water discharge opening (49) which, together with said water discharge opening (50) in said floor (11) of said lower housing part (10), forms a water discharge from said external housing and said internal housing.

6. A control device according to claim 5, wherein said aspirating conduit (52) from said inner chamber of said aspirating hood (34) to said aspirating opening (54) of said blower hood (35) is formed by a wall of said filter hood (47) and by a portion of an outer wall of said blower hood (35) and is covered by means of an area formed by an overhang on said aspirating hood (34), and said aspirating hood (34) is recessed in said area of said overhang.

7. A control device according to claim 6, wherein said electric motor (32) is surrounded on its end facing said cover (39, 40) of said fan wheel by an electric heating element (38) located in said inner chamber of said internal housing.

8. A control device according to claim 7, wherein positioning pieces (45) are provided on an inner wall of said connecting piece (42).

9. A control device according to claim 8, wherein said lower housing part (10) and said upper housing part (16) overlap in the area of the separating plane (17) by means of oppositely offset connecting pieces which are of reduced thickness.

10. A control device according to claim 9, wherein ends of said blower hood (35) on its side facing said aspirating hood (34) form a coaxial double connecting piece into which a facing front end of said aspirating hood (34) is inserted.

11. A control device according to claim 10, wherein said blower hood (35) is supported on said floor (11) of said lower housing part (10) by means of a lower profile packing (41) and said filter hood (47).

12. A control device according to claim 11, wherein said lower housing part (10) and said upper housing part (16) have raised bolt covers (15, 18) aligned with each other, through which they are both bolted together.

13. A control device according to claim 12, wherein said raised bolt covers (15) of said lower housing part (10) extend beyond an underside of said floor (11) of said lower housing part (10) to form receiver sleeves (14) for flexible footpads (53).

14. A control device according to claim 13, wherein said air aspirating openings (12) of said lower housing part (10) are formed in a shape of sleeves which are open in an area of the floor (11) of said lower housing part (10) and which extend into said inner chamber of said external housing.

15. A control device according to claim 1, wherein an upper part of said electric motor (32) is covered by a guide hood (30), said guide hood (30) being held in an upper opening of said aspirating hood (34) by means of said profile packing (29), said guide hood (30) is supported through said profile packing (29) on a sleeve-like piece (19) with inlet slits (20) on a cover wall of said upper housing part (16), and said aspirating chamber (31) is formed between said guide hood (30) and said cover wall of said upper housing part (16).

16. A control device according to claim 1, wherein said aspirating opening (54) of said blower hood (35) is covered by means of a filter (46).

17. A control device according to claim 16, wherein said filter (46) extends into a filter hood (47) which is connected, by means of slits (48) in a wall, with said aspirating conduit (52) extending from an inner chamber of said aspirating hood (34), and said filter hood (47) sits on said floor (11) of said lower housing part (10) and has a water discharge opening (49) which, together with said water discharge opening (50) in said floor (11) of said lower housing part (10), forms a water discharge from said external housing and said internal housing.

18. A control device according to claim 1, wherein said aspirating conduit (52) from said inner chamber of said aspirating hood (34) to said aspirating opening (54) of said blower hood (35) is formed by a wall of a filter hood (47) and by a portion of an outer wall of said blower hood (35) and is covered by means of an area formed by an overhang on said aspirating hood (34), and said aspirating hood (34) is recessed in said area of said overhang.

19. A control device according to claim 1, wherein said electric motor (32) is surrounded on its end facing said cover (39, 40) of said fan wheel by an electric heating element (38) located in said inner chamber of said internal housing.

20. A control device according to claim 1, wherein positioning pieces (45) are provided on an inner wall of said connecting piece (42).

21. A control device according to claim 1, wherein said lower housing part (10) and said upper housing part (16) overlap in the area of the separating plane (17) by means of oppositely offset connecting pieces which are of reduced thickness.

22. A control device according to claim 1, wherein ends of said blower hood (35) on its side facing said aspirating hood (34) form a coaxial double connecting piece into which a facing front end of said aspirating hood (34) is inserted.

23. A control device according to claim 1, wherein said blower hood (35) is supported on said floor (11) of said lower housing part (10) by means of a lower profile packing (41) and a filter hood (47).

24. A control device according to claim 1, wherein said lower housing part (10) and said upper housing part (16) have raised bolt covers (15, 18) aligned with each other, through which they are both bolted together.

25. A control device according to claim 23, wherein said raised bolt covers (15) of said lower housing part (10) extend beyond an underside of said floor (11) of said lower housing part (10) to form receiver sleeves (14) for flexible footpads (53).

26. A control device according to claim 1, wherein said air aspirating openings (12) of said lower housing part (10) are formed in a shape of sleeves which are open in an area of the floor (11) of said lower housing part (10) and which extend into said inner chamber of said external housing.

* * * * *